US011175605B2

(12) United States Patent
Nieda

(10) Patent No.: US 11,175,605 B2
(45) Date of Patent: Nov. 16, 2021

(54) POWDER CONTAINER HAVING A ROTATOR WITH A FLAP TO CONTACT A WALL OF THE POWDER CONTAINER

(71) Applicant: Ricoh Company, Ltd., Tokyo (JP)

(72) Inventor: Hiroaki Nieda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/030,448

(22) Filed: Sep. 24, 2020

(65) Prior Publication Data

US 2021/0157256 A1 May 27, 2021

(30) Foreign Application Priority Data

Nov. 21, 2019 (JP) ..... JP2019-210191

(51) Int. Cl.
*G03G 15/08* (2006.01)

(52) U.S. Cl.
CPC ..... *G03G 15/0877* (2013.01); *G03G 15/0889* (2013.01); *G03G 15/0891* (2013.01)

(58) Field of Classification Search
CPC ..... G03G 15/0877; G03G 15/0891; G03G 15/0867; G03G 15/0875; G03G 15/0889; G03G 15/0887; G03G 2215/0802; G03G 2215/085; G03G 2215/0675; G03G 2215/068
See application file for complete search history.

(56) References Cited

U.S. PATENT DOCUMENTS 5,202,732 A * 4/1993 Yahata ..... G03G 15/0822 399/263
5,870,652 A * 2/1999 Kanamori ..... G03G 15/0872 399/106
6,070,035 A * 5/2000 Fujita ..... G03G 15/0879 399/258
2006/0198643 A1* 9/2006 Kimura ..... G03G 15/0875 399/27
2007/0280739 A1* 12/2007 Tanaka ..... G03G 15/0808 399/254
2011/0026974 A1* 2/2011 Kunihiro ..... G03G 15/0877 399/263
2018/0224779 A1 8/2018 Tomita et al.
2019/0243284 A1 8/2019 Nieda
2019/0243285 A1 8/2019 Nieda
2019/0286011 A1 9/2019 Nieda et al.
2019/0361374 A1 11/2019 Nieda
(Continued)

FOREIGN PATENT DOCUMENTS

JP 2000-321855 11/2000
JP 2001-166576 6/2001
(Continued)

*Primary Examiner* — Walter L Lindsay, Jr.
*Assistant Examiner* — Laura Roth
(74) *Attorney, Agent, or Firm* — Xsensus LLP

(57) ABSTRACT

A powder container includes a rotator configured to rotate on a rotation axis as a rotation center. The rotator includes a flap configured to contact and rub against an inner wall surface of the powder container. The flap includes a base extending from the rotation axis as the rotation center in a radial direction and a bent portion bent from the base in a direction intersecting the radial direction and toward downstream in a rotation direction of the rotator.

15 Claims, 10 Drawing Sheets

(56) References Cited

U.S. PATENT DOCUMENTS

| | | | |
|---|---|---|---|
| 2020/0166872 | A1 | 5/2020 | Kita et al. |
| 2020/0166886 | A1 | 5/2020 | Saito et al. |

FOREIGN PATENT DOCUMENTS

| | | |
|---|---|---|
| JP | 2002-006614 | 1/2002 |
| JP | 2010-169977 | 8/2010 |
| JP | 2019-204043 | 11/2019 |

* cited by examiner

POWDER CONTAINER HAVING A ROTATOR WITH A FLAP TO CONTACT A WALL OF THE POWDER CONTAINER

CROSS-REFERENCE TO RELATED APPLICATION

This patent application is based on and claims priority pursuant to 35 U.S.C. § 119 to Japanese Patent Application No. 2019-210191 filed on Nov. 21, 2019 in the Japan Patent Office, the entire disclosures of which are hereby incorporated by reference herein.

BACKGROUND

Technical Field

Embodiments of the present disclosure generally relate to a powder container to store powder therein, a developing device and a process cartridge that include the powder container as a toner container, and an image forming apparatus, such as a copier, a printer, a facsimile machine, or a multifunction peripheral (MFP) having one or more such functions, that is adapted to incorporate the developing device or the process cartridge.

Background Art

In an image forming apparatus such as a copier, a printer and a facsimile, a toner container as a powder container is known in which a flexible member such as a plastic film rotates about a rotation shaft and stirs toner in the toner container.

SUMMARY

This specification describes a powder container that includes a rotator configured to rotate on a rotation axis as a rotation center. The rotator includes a flap configured to contact and rub against an inner wall surface of the powder container. The flap includes a base extending from the rotation axis as the rotation center in a radial direction and a bent portion bent from the base in a direction intersecting the radial direction and toward downstream in a rotation direction of the rotator.

This specification further describes a developing device that includes a rotator configured to rotate on a rotation axis as a rotation center. The rotator includes a flap configured to contact and rub against an inner wall surface of the powder container. The flap includes a base extending from the rotation axis as the rotation center in a radial direction and a bent portion bent from the base in a direction intersecting the radial direction and toward downstream in a rotation direction of the rotator.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
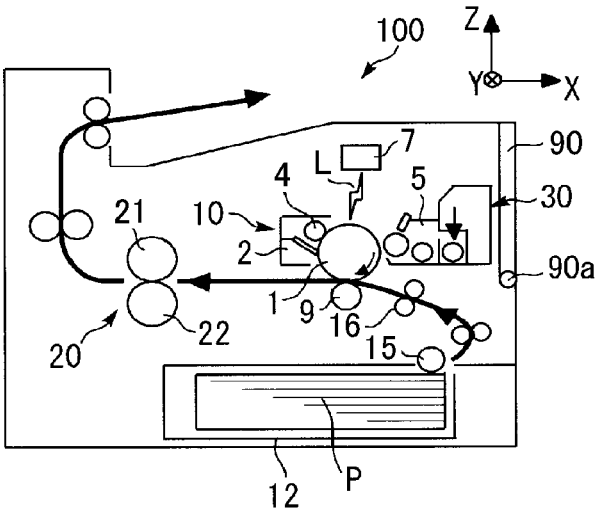
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure, and all of the components or elements described in the embodiments of this disclosure are not necessarily indispensable.

With reference to the drawings, embodiments of the present disclosure are described below. Identical reference numerals are assigned to identical components or equivalents and a description of those components is simplified or omitted.

With reference to the drawings, embodiments of the present disclosure are described below. Identical reference numerals are assigned to identical components or equivalents and a description of those components is simplified or omitted.

With reference to FIG. 1, a configuration and operation of an image forming apparatus 100 is described below.

In FIG. 1, the image forming apparatus 100 that is a printer in the present embodiment includes a photoconductor drum 1 on which a toner image is formed, and an exposure device (or a writing device) 7 that irradiates the photoconductor drum 1 with exposure light L based on image data input from an input device such as a personal computer.

The image forming apparatus 100 further includes: a transfer roller 9 to transfer a toner image borne on a surface of the photoconductor drum 1 onto a sheet P conveyed to a transfer nip (i.e., a transfer position); a process cartridge 10 in which the photoconductor drum 1, a charging roller 4, a developing device 5, a cleaner 2, and a waste toner conveyor 6 (see FIG. 2) are united; and a sheet feeder (or a sheet tray) 12 to accommodate the sheets P such as paper sheets.

The image forming apparatus 100 yet further includes a registration roller pair (or a timing roller pair) 16 to feed the sheet P toward the transfer nip where the photoconductor drum 1 contacts the transfer roller 9, a fixing device 20 to fix an unfixed image on the sheet P, and a toner container 30 as a powder container. The fixing device 20 includes a fixing roller 21 and a pressure roller 22.

The above-described image forming apparatus 100 includes the charging roller 4, the developing device 5, the cleaner 2, the waste toner conveyor 6, and the like around the photoconductor drum 1. The above members (i.e., the photoconductor drum 1, the charging roller 4, the developing device 5, the cleaner 2, and the waste toner conveyor 6) are integrated as the process cartridge 10. The process cartridge 10 is removably (or replaceably) mounted in a main body of the image forming apparatus 100. The process cartridge 10 is replaced with a new process cartridge in a certain replacement cycle.

The toner container 30 is set on the developing device 5 of the process cartridge 10 to be able to remove from or installed in the main body of the image forming apparatus 100, that is, to be replaceable. The toner container 30 includes a toner storage 31 (see FIG. 2) to store fresh toner. The toner is appropriately supplied from the toner container 30 to the inside of the developing device 5. When the toner container 30 runs out of toner (or toner contained in the developing device 5 is depleted), the toner container 30 is replaced with a new toner container. Note that, the toner container 30 according to the present embodiment further includes a waste toner collection portion 32 (see FIG. 2) to collect waste toner in addition to the toner storage 31 to store fresh toner. The waste toner collection portion 32 is described in detail later.

Figure 2:
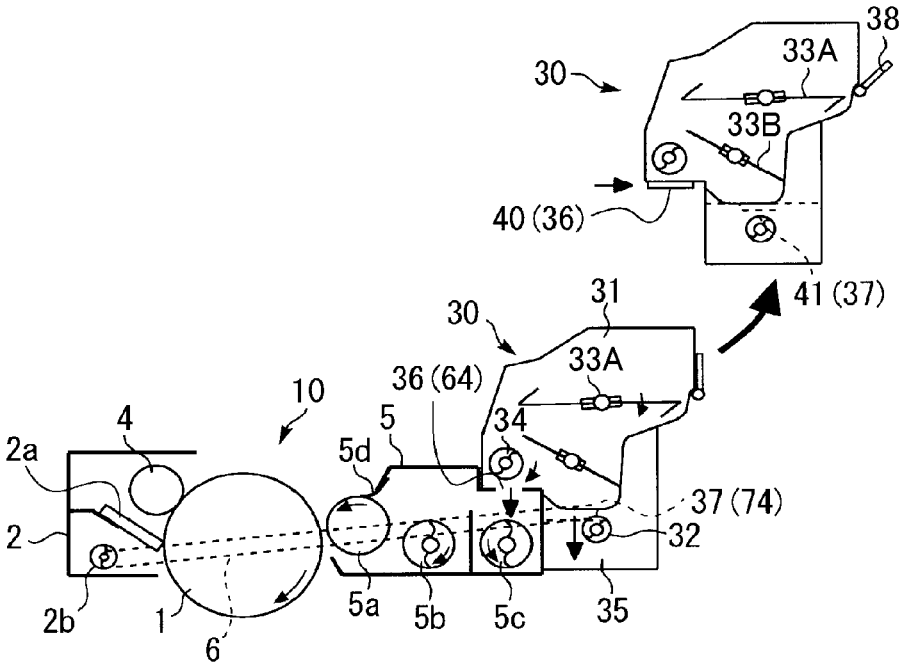
FIG. 2 is a schematic view illustrating a process cartridge and a toner container as a powder container according to an embodiment of the present disclosure.

Now, a description is given of the image forming operations performed by the image forming apparatus 100 with reference to FIGS. 1 and 2.

With reference to FIG. 1, the input device such as the personal computer sends the image data to the exposure device 7 in the image forming apparatus 100, and the exposure device 7 irradiates the surface of the photoconductor drum 1 with the exposure light (or a laser beam) L based on the image data.

The photoconductor drum 1 rotates in a direction indicated by arrow in FIG. 1, that is, a clockwise direction. Initially, the charging roller 4 uniformly charges the surface of the photoconductor drum 1 opposite the charging roller 4, which is called a charging process. As a result, a charging potential is formed on the surface of the photoconductor drum 1. In the present embodiment, the charging potential on the photoconductor drum 1 is approximately −900 V. The charged surface of the photoconductor drum 1 thereafter reaches a position to receive the exposure light L. An electric potential at the position that receives the exposure light L serves as a latent image potential (of about 0 to −100 V), and an electrostatic latent image is formed on the surface of the photoconductor drum 1, which is called an exposure process.

The surface of the photoconductor drum 1 bearing the electrostatic latent image thereon then reaches a position opposite the developing device 5. The developing device 5 supplies toner onto the photoconductor drum 1, and the latent image formed on the photoconductor drum 1 is thereby developed into a toner image, which is called a developing process.

As illustrated in FIG. 2, the developing device 5 includes the developing roller 5*a*, two development conveying screws 5*b* and 5*c*, and a doctor blade 5*d*. The developing device 5 contains toner, that is, one-component developer. The toner is supplied from a discharge port 36 of the toner container 30 (or the toner storage 31) to the developing device 5 via an inlet port 64 of the developing device 5 according to consumption of toner in the developing device 5. The two conveying screws 5*b* and 5*c* stir and mix the supplied toner with the toner contained in the developing device 5 while circulating the toner in a longitudinal direction of the developing device 5, which is a direction perpendicular to the surface of the paper on which FIG. 2 is drawn. The developing roller 5*a* scoops up a part of the toner conveyed by the conveying screw 5*b*. The toner scooped up by the developing roller 5*a* is regulated by the doctor blade 5*d* and reaches a position opposite the photoconductor drum 1 that is called a developing range. The doctor blade 5*d* rubs the toner on the developing roller 5*a* and triboelectrically charges the toner. The regulated toner adheres to the electrostatic latent image on the photoconductor drum 1 in the developing range, thereby forming the toner image on the photoconductor drum 1. A drive motor disposed in the main body of the image forming apparatus 100 rotates the developing roller 5*a* and the two conveying screws 5*b* and 5*c* in directions indicated by arrows in FIG. 2.

After the developing process, the surface of the photoconductor drum 1 bearing the toner image thereon reaches the transfer nip (i.e., the transfer position) formed between the photoconductor drum 1 and the transfer roller 9. In the transfer nip, a transfer bias having an opposite polarity to toner is applied from a power source to the transfer roller 9, and the toner image formed on the photoconductor drum 1 is thereby transferred onto the sheet P fed by the registration roller pair 16, which is called a transfer process.

The surface of the photoconductor drum 1 after the transfer process reaches a position opposite the cleaner 2. At the position opposite the cleaner 2, a cleaning blade 2*a* mechanically removes untransferred toner remaining on the surface of the photoconductor drum 1, and removed toner is collected in the cleaner 2, which is called a cleaning process.

A series of image forming processes on the photoconductor drum 1 is thus completed.

The untransferred toner collected in the cleaner 2 is conveyed by a collection screw 2*b* to one end of the cleaner 2 in a width direction that is a rotation axis direction of the collection screw 2*b*, conveyed in a diagonally upper right direction in FIG. 2 by the waste toner conveyor 6 including a waste toner coil 6*a*, and collected as waste toner from an outlet port 74 of the waste toner conveyor 6 to the inside of the waste toner collection portion 32 of the toner container 30 via a collection port 37 of the toner container 30.

In the new toner container 30, the toner storage 31 is filled with fresh toner, and the waste toner collection portion 32 is empty.

The sheet P is conveyed to the transfer nip (i.e., the transfer position) between the photoconductor drum 1 and the transfer roller 9 as follows.

First, a feed roller 15 feeds the sheet P stored at the top in the sheet feeder 12 toward a conveyance passage.

The sheet P thereafter reaches the position of the registration roller pair 16. The sheet P is fed from the position of the registration roller pair 16 to the transfer nip (i.e., contact position of the transfer roller 9 with the photoconductor drum 1) in synchronization with an entry of the toner image formed on the photoconductor drum 1 into the transfer nip.

After the transfer process, the sheet P passes through the transfer nip (i.e., the position of the transfer roller 9) and reaches the fixing device 20 through the conveyance passage. In the fixing device 20, the sheet P is interposed between the fixing roller 21 and the pressure roller 22. The toner image is fixed on the sheet P by heat applied from the fixing roller 21 and pressure applied from both fixing roller 21 and the pressure roller 22. After the sheet P having the fixed toner image thereon is ejected from the fixing nip formed between the fixing roller 21 and the pressure roller 22, the sheet P is ejected from the body of the image forming apparatus 100 and stacked on an output tray.

A series of image forming processes is thus completed.

Figure 3A:
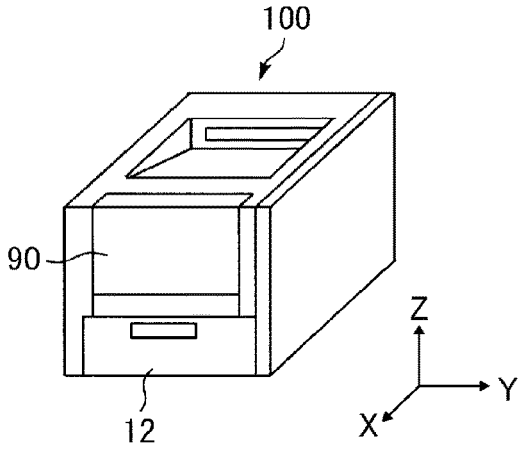
FIG. 3A is a perspective view of the image forming apparatus of FIG. 1.
Figure 3B:
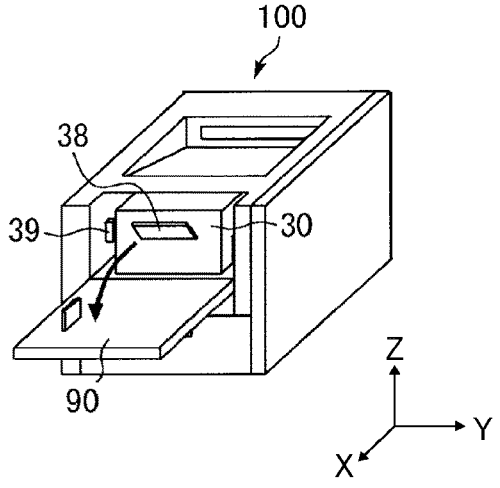
FIG. 3B is a perspective view of the image forming apparatus of FIG. 1 with a cover open.

According to the present embodiment, the image forming apparatus 100 is covered with a plurality of exterior covers as illustrated in FIG. 3A. As illustrated in FIG. 3B, a part of a front exterior cover functions as a cover 90 that is rotatably opened and closed.

Specifically, the cover 90 is secured to the main body of the image forming apparatus 100 and hinged around a spindle 90*a* as a rotation shaft as illustrated in FIG. 1. As the cover 90 rotates counterclockwise in FIG. 1 around the spindle 90*a*, the cover 90 closes as illustrated in FIGS. 1 and 3A. As the cover 90 rotates clockwise in FIG. 1 around the spindle 90*a*, the cover 90 opens as illustrated in FIG. 3B.

Figure 4:
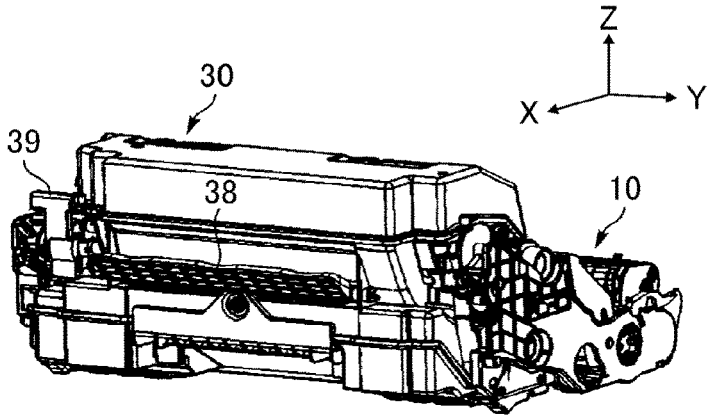
FIG. 4 is a perspective view of the process cartridge of FIG. 2 to which the toner container is attached.
Figure 7:
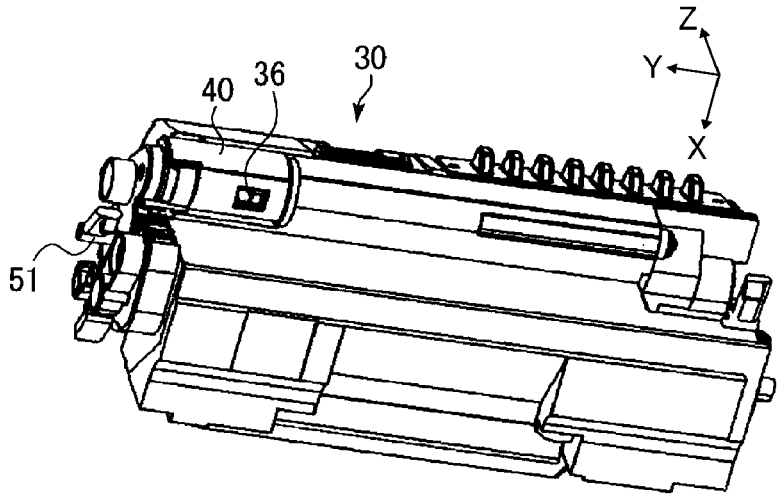
FIG. 7 is a perspective view of the toner container of FIG. 2 when viewed from below with a first shutter (or a discharge port) opened, according to an embodiment of the present disclosure.

In the present embodiment, the cover 90 opened as illustrated in FIG. 3B reveals the toner container 30 to be installable in and removable from the main body of the image forming apparatus 100. Opening the cover 90 enables replacing only the toner container 30 as illustrated in FIG. 7 with a new toner container or, alternatively, replacing the toner container 30 together with the process cartridge 10 with a new one that is the process cartridge 10 and the toner container 30 as illustrated in FIG. 4.

When the cover 90 closes as illustrated in FIG. 1, image forming processes that are printing operations described above with reference to FIG. 1 are performed.

The configuration and operations of the toner container 30 according to the present embodiment are described in detail below.

In the present embodiment, as illustrated in FIG. 2, the toner container 30 is detachably attachable to the process cartridge 10. In particular, in the present embodiment, the toner container 30 is attachable to and detachable from the process cartridge 10 in both states in which the process cartridge 10 is installed in the image forming apparatus 100 and in which the process cartridge 10 is removed from the image forming apparatus 100.

As described above with reference to FIG. 3B, the toner container 30 is attachable to and detachable from the process cartridge 10 installed in the image forming apparatus 100. In other words, the toner container 30 is indirectly installable in and removable from the image forming apparatus 100.

In the present embodiment, the toner container 30 is configured to be indirectly installable in and removable from the image forming apparatus 100. Alternatively, the toner container 30 may be configured to be directly installable in and removable from the image forming apparatus 100.

The process cartridge 10 is the removable component that is installable in and removable from the image forming apparatus 100. Besides the process cartridge 10, the developing device 5 and other devices may function as the removable components. The toner container 30 may be attachable to and detachable from a removable component other than the process cartridge 10.

Figure 5:
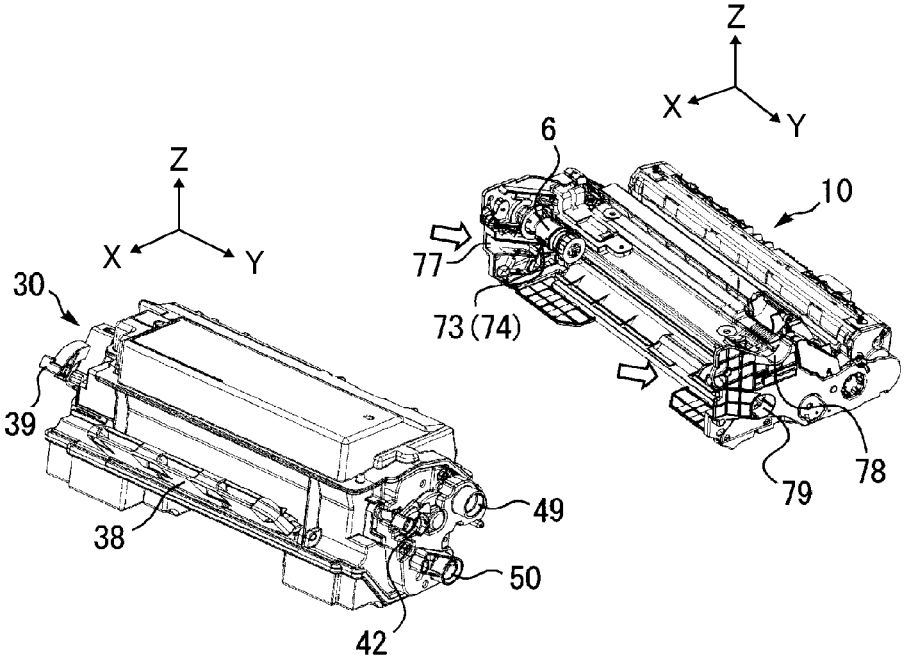
FIG. 5 is a perspective view of the process cartridge of FIG. 4 from which the toner container is detached.
Figure 6A:
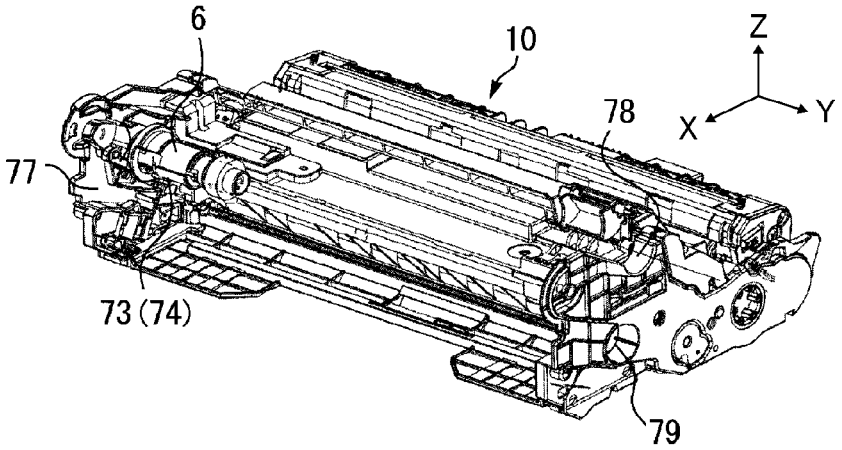
FIGS. 6A and 6B are perspective views of the process cartridge of FIG. 5.
Figure 6B:
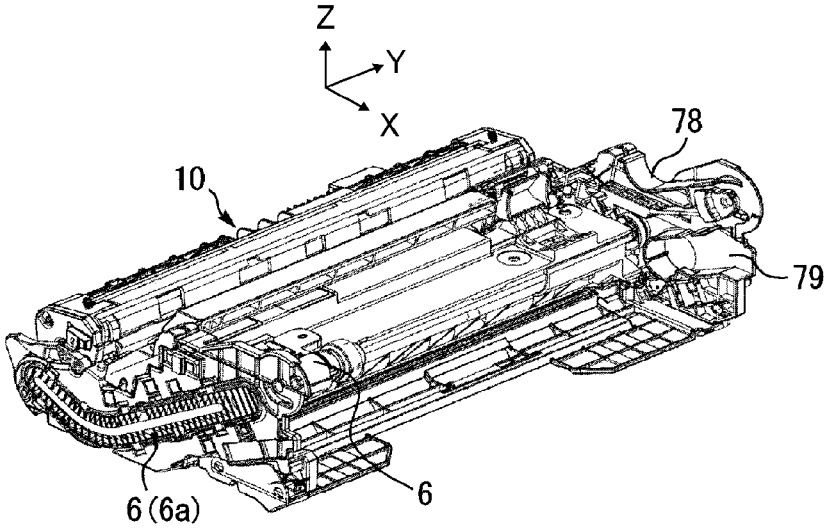

In addition, as illustrated in FIG. 4, the toner container 30 attached to the process cartridge 10 is installable in and removable from the image forming apparatus 100 as a single removable component. As illustrated in FIG. 5, an operator such as a user moves the toner container 30 in a predetermined direction indicated by a fat arrow in FIG. 5 to set the toner container 30 on the process cartridge 10 and moves the toner container 30 in a direction opposite the predetermined direction to remove the toner container 30 from the process cartridge 10. The toner container 30 alone as illustrated in FIG. 7 is distributed in the market. The process cartridge 10 alone as illustrated in FIGS. 6A and 6B is similarly distributed in the market.

The toner container 30 includes a handle 38 disposed on the front side of the toner container 30 in a direction of detachment operation, that is, a positive X-direction as illustrated in FIGS. 2 to 5. The operator such as the user grips the handle 38 to pull the toner container 30 out of the process cartridge 10 (or the image forming apparatus 100) or push the toner container 30 into the process cartridge 10 (or the image forming apparatus 100) when the toner container 30 is attached to or detached from the process cartridge 10 (or the image forming apparatus 100). The handle 38 is foldable. When the cover 90 closes in a state in which the toner container 30 is installed in the image forming apparatus 100 with the handle 38 standing up as illustrated in FIGS. 4 and 5, the handle 38 is pushed by the cover 90 in conjunction with movement of the cover 90 from an open state to a closed state, thereby accommodating the handle 38 along an exterior of the toner container 30.

Figure 8:
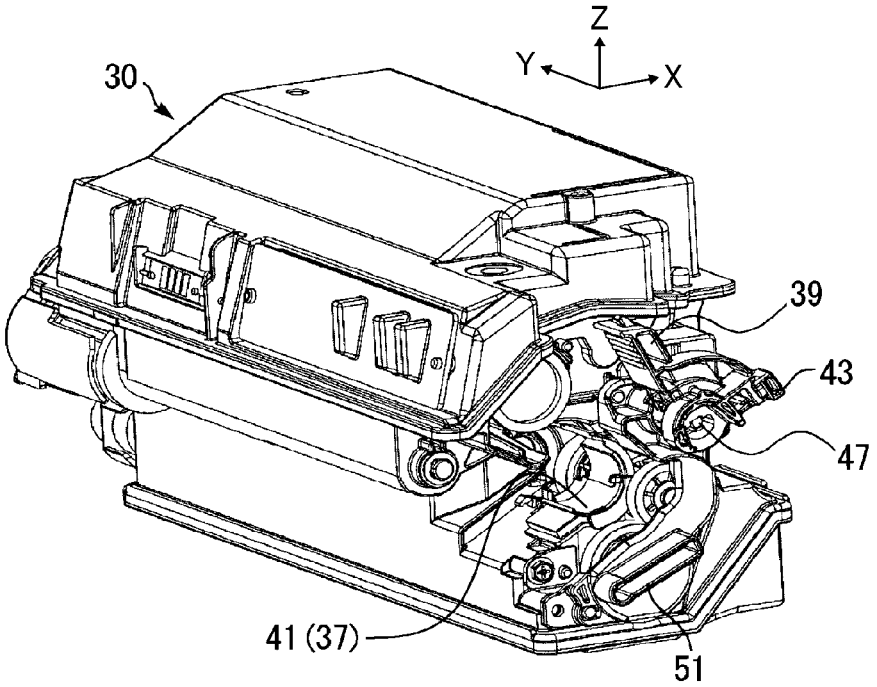
FIG. 8 is a perspective view of the toner container of FIG. 7 when viewed from the collection port side with a second shutter (a collection port) closed.

The toner container 30 includes a first positioning portion 49 and a second positioning portion 50 as illustrated in FIG. 5 and a guide 51 as illustrated in FIGS. 7 and 8. The process cartridge 10 includes a plurality of guide grooves 77 and 79 and a guide receiver 78. The first positioning portion 49, the second positioning portion 50, and the guide 51 engage with the multiple guide grooves 77 and 79 and the guide receiver 78, respectively. Thus, the toner container 30 can be attached to and detached from the process cartridge 10 and positioned in the process cartridge 10.

Specifically, the first positioning portion 49 and the second positioning portion 50 project from one end face of the toner container 30 in the width direction of the toner container 30 that is the positive Y-direction in FIG. 5 and form positioning projections. The guide receiver 78 and the guide groove 79 are disposed on one end face of the process cartridge 10 in the width direction of the process cartridge 10. The one end face of the process cartridge 10 corresponds to the one end face of the toner container 30. The guide 51 projects from the other end face of the toner container 30 in the negative Y-direction in FIG. 5 and has a rectangular shape which is inclined upward and extends in the positive X-direction in FIG. 8. The guide groove 77 is disposed at the other end face of the process cartridge 10 in the width direction of the process cartridge 10. The guide receiver 78 receives the first positioning portion 49, the guide groove 79 receives the second positioning portion 50, and the guide groove 77 receives the guide 51. Thus, the toner container 30 is attached to the process cartridge 10. The toner container 30 is positioned in the process cartridge 10 so that the first and second positioning portions 49 and 50 engage dead ends of the guide receiver 78 and the guide groove 79, respectively, and the guide 51 engages a dead end of the guide groove 77.

The first positioning portion 49 is a projection surrounding a coupling that transmits a driving force from the image forming apparatus 100 to a first stirrer 33A (see FIGS. 2 and 9) to stir toner. The driving force input to the first stirrer 33A is transmitted to the second stirrer 33B via an idle gear, and the first stirrer 33A and the second stirrer 33B rotate clockwise in FIG. 9.

Figure 9:
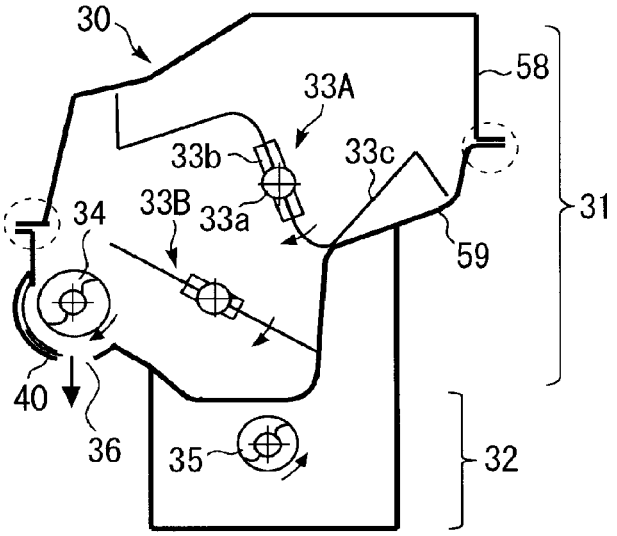
FIG. 9 is a schematic view illustrating an inside of the toner container of FIG. 7.

The second positioning portion 50 is a projection surrounding a coupling gear to rotate a waste toner conveying screw 35 (see FIGS. 2 and 9). As described above, input portions to receive the driving force from the image forming apparatus 100 are disposed near or inside the first positioning portion 49 and the second positioning portion 50, enabling reliable driving force transmission.

The toner container 30 includes the discharge port 36, a collection port 37, a first shutter 40, and a second shutter 41.

With reference to FIGS. 2, 7, and 9, the discharge port 36 of the toner container is an opening to discharge toner stored in the toner storage 31 of the toner container to the developing device 5. The discharge port 36 communicates with the inlet port 64 of the developing device 5 when the toner container 30 is attached to the process cartridge 10. The inlet port 64 is an opening disposed above the second conveying screw 5*c*.

Figure 10:
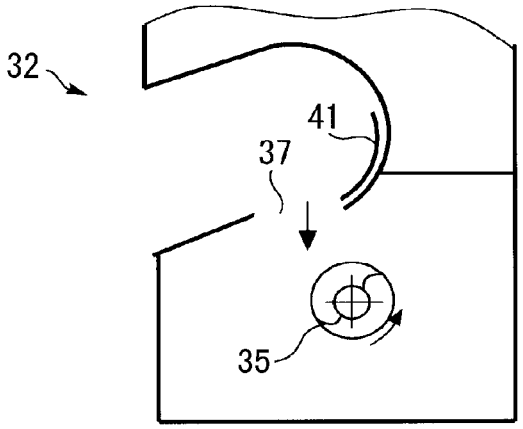
FIG. 10 is a schematic view illustrating a waste toner collection portion of the toner container of FIG. 9.

With reference to FIGS. 2, 8, and 10, the collection port 37 of the toner container 30 is an opening to receive waste toner (untransferred toner) from the outside of the toner container 30 and to collect the waste toner in the toner container 30. The collection port 37 communicates with the outlet port 74 of the waste toner conveyor 6 when the toner container 30 is attached to the process cartridge 10. The outlet port 74 (see FIGS. 5 and 6) is an opening disposed on a bottom face of a downstream end of the waste toner conveyor 6 in a direction of conveyance of the waste toner.

In the toner container 30 according to the present embodiment, with reference to FIGS. 2, 9, and 10, the toner storage 31 and the waste toner collection portion 32 are separated by a wall, the toner storage 31 stores toner discharged from the discharge port 36, and the waste toner collection portion 32 collects the waste toner received from the collection port 37. The toner storage 31 includes an upper case 58 and a lower case 59.

The toner storage 31 further includes a supply screw 34 as a conveyor that rotates clockwise in FIGS. 2 and 9 and the first stirrer 33A and the second stirrer 33B that serve as agitators and rotate clockwise in FIGS. 2 and 9.

The supply screw 34 as the conveyor discharges a target amount of toner stored in the toner storage 31 from the discharge port 36 according to a drive timing and rotation duration controlled by a controller. In the present embodiment, the supply screw 34 works as the conveyor that conveys the toner stored inside the toner storage 31 of the toner container 30 in a predetermined conveyance direction along the rotation axis direction that is the Y direction. The supply screw 34 transports the toner to the discharge port 36 formed at the end portion in the Y direction.

The first stirrer 33A and the second stirrer 33B each rotate in a predetermined direction about a rotation axis and stir toner stored in the toner storage 31 to prevent toner from aggregating. As illustrated in FIG. 9, the first stirrer 33A and the second stirrer 33B each include a flap 33*c* formed of a thin plate-like Mylar™ (i.e. polyethylene terephthalate (PET) film) or the like (i.e. the flap is a flexible member) and plate-like holders 33*b* that are rigid bodies. The flap 33*c* rotates on a rotation shaft 33*a* that is the rotation axis and the center of rotation. The holder 33*b* is disposed across the rotation shaft 33*a*. The flap 33*c* is sandwiched and held by the holders 33*b*. A housing of the toner container 30 rotatably supports both ends of the first stirrer 33A and both ends of the second stirrer 33B in each of the axial directions through a pair of bearings. A tip of the flap 33*c* of the first stirrer 33A serving as a rotator, which is a free end, is bent to form a bent portion 33*c*2. The bent portion 33*c*2 is described later in detail with reference to FIGS. 11 to 13.

The waste toner collection portion 32 that is a powder collection portion includes the waste toner conveying screw 35 that rotates counterclockwise in FIG. 2. The waste toner conveying screw 35 conveys waste toner so that the waste toner that flows through the collection port 37 does not accumulate under the collection port 37 and is evenly distributed in the waste toner collection portion 32.

In the present embodiment, as the operator pivots a lever 39 of the toner container 30 attached to the process cartridge 10 (or the image forming apparatus 100), the first shutter 40 in the discharge port 36 and the second shutter 41 in the collection port 37 simultaneously open and close. In addition to the first shutter 40 and the second shutter 41, the inlet port 64 and the outlet port 74 of the process cartridge 10 also simultaneously open and close. Therefore, open and close failures are prevented in the first shutter 40, the second shutter 41, the first cartridge shutter 63, and the second cartridge shutter 73.

The lever 39 is arranged to be exposed to the outside as illustrated in FIG. 3B and operable by the operator when the cover 90 is opened in the main body of the image forming apparatus 100 in which the toner container 30 is installed.

The toner container 30 further includes a first rotation portion 42 as illustrated in FIG. 5. In the width direction of the toner container 30, the first rotation portion 42 is disposed opposite the lever 39 and the second rotation portion 43 which are illustrated in FIG. 8. The first rotation portion 42 is coupled to the second rotation portion 43 via a shaft and rotates together with the lever 39, the second rotation portion 43, and the shaft.

The configuration and operations of the toner container 30 according to the present embodiment are described in detail below.

As described above with reference to FIG. 9, the toner container 30 according to the present embodiment includes the first stirrer 33A serving as the rotator that rotates on the rotation shaft 33*a* that is the rotation axis in a predetermined rotation direction, that is, clockwise in FIG. 9.

Figure 11:
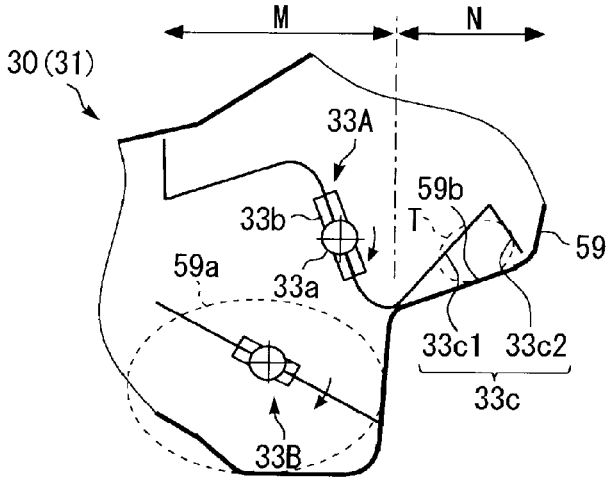
FIG. 11 is a schematic view illustrating a main part of the toner container of FIG. 9.
Figure 12:
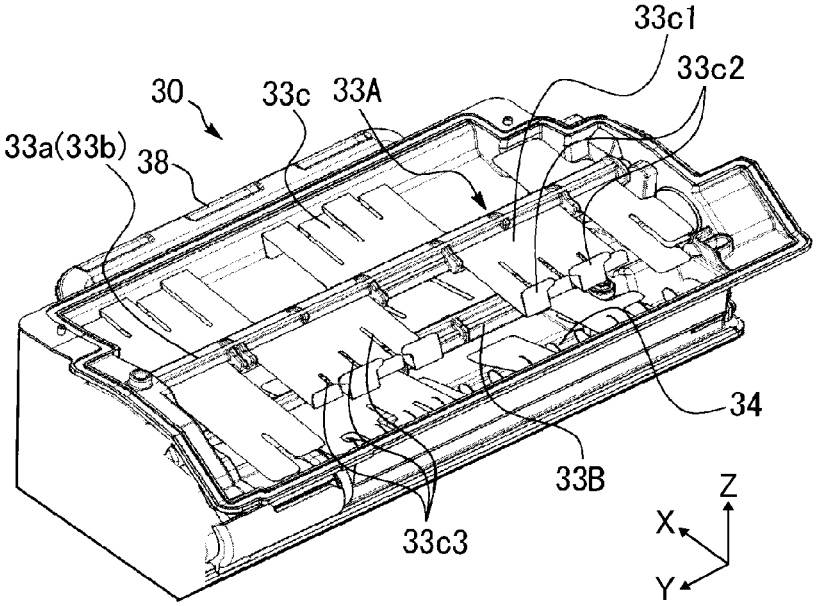
FIG. 12 is a perspective view illustrating the inside of a toner storage of the toner container of FIG. 9.

As illustrated in FIGS. 11 and 12, the first stirrer 33A includes the rotation shaft 33*a*, the holders 33*b*, the flap 33*c*.

The rotation shaft 33*a* is rotatably held by bearings on side walls located at both ends of the toner storage 31 of the toner container 30 in the width direction of the toner container 30.

The flap 33*c* slides on a sliding contact surface 59*b* that is an inner wall surface of the toner storage 31 of the toner container 30. In the present embodiment, the flap 33*c* is a sheet-shaped member made of polyethylene terephthalate (PET) having a thickness of about 0.05 to 0.1 mm. In the present embodiment, the sliding contact surface 59*b* that is the inner wall surface of the toner storage 31 is a slope formed away from the supply screw 34 in the lower case 59 via a reservoir 59*a* that includes the second stirrer 33B and mainly stores toner. The sliding contact surface 59*b* is formed to incline downward toward the reservoir 59*a*. The sliding contact surface 59*b* is connected to a wall surface of the reservoir 59*a* extending in a substantially vertical direction. The reservoir 59*a* is disposed downstream from the sliding contact surface 59*b* in the rotational direction of the first stirrer 33A. The flap 33*c* of the first stirrer 33A slides on the sliding contact surface 59*b* and scrapes off the toner on the sliding contact surface 59*b*. The toner scraped off is stored in the reservoir 59*a*.

The holder 33*b* is a rigid plate-shaped member formed of a resin material or the like. The holder 33*b* extends from the center of the rotation shaft 33*a* in the radial direction of the first stirrer 33A. A part of base 33*c*1 of the flap 33*c* is sandwiched and held by the holders 33*b*. The part of base 33*c*1 of the flap 33*c* may be sandwiched and held by the two holders 33*b*. Alternatively, the base 33*c*1 may be set to a single holder having a groove to which the base 33*c*1 is set. The rotation shaft having a through-hole or a groove may serve as the holder, and the base 33*c*1 may be set to the through-hole or the groove.

The flap 33*c* according to the present embodiment includes a base 33*c*1 and a bent portion 33*c*2. The base 33*c*1 extends from the rotation shaft 33*a* that is the rotation axis in the radial direction. The bent portion 33*c*2 is bent from the base 33*c*1 in a direction intersecting the radial direction and toward downstream in the rotation direction.

That is, the flap 33*c* is not a flat plate. The flap 33*c* includes the base 33*c*1 that is flat and extends in the radial direction and the bent portion 33*c*2 bent from the base 33*c*1. The distal end of the bent portion 33*c*2 is positioned downstream in the rotation direction from the bottom of the bent portion 33*c*2 at which the flap 33*c* is bent to form the bent portion 33*c*2.

The flap 33*c* has the above-described shape when no external force is applied. When the flap 33*c* slides on the sliding contact surface 59*b*, the flap 33*c* is deformed as illustrated in FIG. 11.

The above-described bent portion 33*c*2 disposed on the flap 33*c* of the first stirrer 33A serving as the rotator prevents the toner T from adhering and fixing onto the sliding contact surface 59*b* that is the inner wall surface of the toner container 30. Even if the toner T adheres to the sliding contact surface 59*b*, the flap 33*c* can sufficiently scrape off the adhered toner T.

Figure 15A:
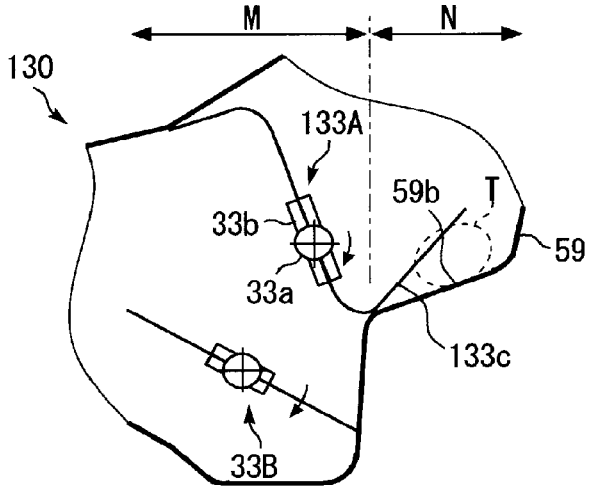
FIGS. 15A and 15B are schematic views illustrating main parts of toner containers of comparative examples.

With reference to FIG. 15A, a comparative example is described. In the comparative example, a flap 133*c* of a first stirrer 133A disposed in a toner container 130 does not have the bent portion and cannot sufficiently scrape off the toner T on the sliding contact surface 59*b*. Therefore, the toner T adheres to the sliding contact surface 59*b*.

In contrast, the bent portion 33*c*2 of the toner container 30 according to the present embodiment slides on the sliding contact surface 59*b*, functions like a hoe, and completely scrapes the toner T stayed on a part surrounded by a broken line in FIG. 11 into the reservoir 59*a*. In particular, the above-described bent portion 33*c*2 achieves greater effectiveness when an amount of toner in the toner storage 31 of the toner container 30 decreases.

Decreasing the toner adhered to the sliding contact surface 59*b* that is the inner wall surface as described above decreases residual toner and enables the operator to replace the toner container 30 with a new one with no waste.

The base 33*c*1 of the flap 33*c* is designed to have a sufficiently long radial length so that a face of the base 33*c*1 contacts the sliding contact surface 59*b* that is the inner wall surface. The face of the sufficiently long base 31*c*1 of the flap 33*c* contacts the sliding contact surface 59*b* and slides on the sliding contact surface 59*b*. In addition, the edge of the bent portion 33*c*2 slides on the sliding contact surface 59*b*.

As a result, the bent portion 33*c*2 functions like the hoe and sufficiently scrapes off the toner T on the sliding contact surface 59*b*.

In the flap 33*c* according to the present embodiment, the bend angle θ (see FIG. 13B) of the bent portion 33*c*2 with respect to the base 33*c*1 is formed to be in a range of 60 to 120 degrees.

As a result, the bent portion 33*c*2 functions like the hoe and sufficiently scrapes off the toner T on the sliding contact surface 59*b*.

Particularly, in the present embodiment, the new flap 33*c* before use is formed to have an acute bend angle θ.

This is because the bend angle θ of the bent portion 33*c*2 tends to be larger than the one in the new flap 33*c* as the flap 33*c* repeatedly contacts and slides on the sliding contact surface 59*b*. Preferably, a performance of the bent portion 33*c*2 to scrape off the toner T adhered to the sliding contact surface 59*b* becomes maximum when the toner in the toner container 30 is consumed and the remaining toner amount becomes a little amount, that is, a toner near end timing when the toner container will become empty soon. Therefore, it is preferable for the bend angle θ of the bent portion 33*c*2 to be close to 90 degrees at the toner near end timing. To set the bend angle θ close to 90 degrees at the toner near end timing, in the present embodiment, the bend angle θ of the bent portion 33*c*2 of the new flap 33*c* before use is set to an acute angle smaller than 90 degrees.

Based on the above-described view point, the bend angle θ of the bent portion 33*c*2 of the new flap 33*c* in a large toner container 30 having a large volume to store fresh toner may be set smaller than the bend angle θ of the bent portion 33*c*2 of the new flap 33*c* in a small toner container having a small volume to store fresh toner.

Specifically, the toner container 30 may be manufactured to have different volumes to store the fresh toner even if the toner container 30 has substantially the same configuration. In such a case, the number of times that the flap 33*c* contacts and slides on the sliding contact surface 59*b* at the toner near end timing when the large toner container 30 filled with toner is used is larger than the one when the small toner container 30 filled with toner is used. Accordingly, the bend angle θ of the bent portion 33*c*2 of the flap 33*c* disposed in the large toner container 30 may be set smaller than that of the flap 33*c* disposed in the small toner container 30.

As a result, the toner container 30 can sufficiently scrape off the toner T adhered to the sliding contact surface 59*b* that is the inner wall surface regardless of the volume of the toner container.

In addition to the first stirrer 33A, the toner storage 31 of the toner container 30 according to the present embodiment includes the second stirrer 33B serving as the stirrer to stir the toner stored in the reservoir 59*a*. Similar to the first stirrer 33A, the second stirrer 33B includes a rotation shaft, a flap, and holders. However, the flap of the second stirrer 33B does not include a bent portion like the bent portion 33*c*2 of the flap 33*c* of the first stirrer 33A.

The reservoir 59*a* is arranged downstream in the rotation direction of the first stirrer 33A from the sliding contact surface 59*b* that is the inner wall surface with which the flap 33*c* of the first stirrer 33A slidably contacts. The reservoir 59*a* stores the toner scraped off from the sliding contact surface 59*b* by the flap 33*c* of the first stirrer 33A.

As illustrated in FIG. 11, the rotation shaft 33*a* of the first stirrer 33A serving as the rotator is arranged above the reservoir 59*a*. That is, the rotation shaft 33*a* of the first stirrer 33A is arranged not above the sliding contact surface 59*b* on which the toner is to be scraped off, but above the reservoir 59*a* where the scraped toner drops.

The above-described configuration enables the bent portion 33*c*2 of the flap 33*c* to maintain a force for scraping off the toner until the bent portion 33*c*2 passes through the lower end of the slope of the sliding contact surface 59*b*. As a result, the flap 33*c* can sufficiently scrape off the toner T adhered to the sliding contact surface 59*b*.

Figure 15B:
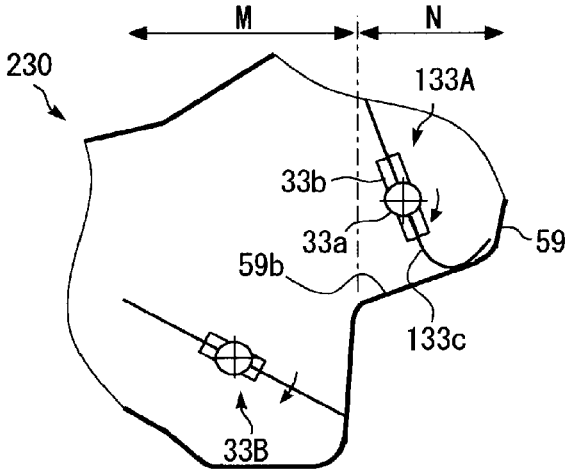

FIG. 15B illustrates another comparative example. In the comparative example, the rotation shaft 133*a* of the first stirrer 133A in the toner container 230 is disposed in the region N above the sliding contact surface 59*b*. The distance between the rotation shaft 133*a* of the first stirrer 133A and the rotation shaft of the second stirrer 33B in the comparative example is greater than that in the present embodiment. As a result, a gear or a gear train to transmit a driving force between the first stirrer 33A and the second stirrer 33B become large, or the gear train needs a lot of gears.

In the present embodiment, the rotation trajectory of the holder 33*b* when the holder 33*b* rotates about the rotation shaft 33*a* in the rotation direction that is the direction indicated by an arrow in FIG. 11 is in a region M above the reservoir 59*a* and does not enter the region N above the sliding contact surface 59*b* that is the inner wall surface. That is, the holder 33*b* of the first stirrer 33A does not rotate in the region N above the sliding contact surface 59*b* on which the toner is to be scraped off, but rotates in the region M above the reservoir 59*a* where the scraped toner drops.

Owing to this structure, until the bent portion 33*c*2 of the flap 33*c* passes through the lower end of the slope of the sliding contact surface 59*b*, the base 33*c*1 bends as illustrated in FIG. 11, and the bent portion 33*c*2 easily contacts to and slides on the sliding contact surface 59*b*. The above-described configuration enables the bent portion 33*c*2 of the flap 33*c* to maintain the force for scraping off the toner, and the flap 33*c* can sufficiently scrape off the toner T adhered to the sliding contact surface 59*b*.

With reference to FIG. 12 and FIG. 13, the flap 33*c* of the first stirrer 33A having a plurality of bent portions is described. The flap 33*c* has a plurality of slits 33*c*3 having start points away from the rotation shaft 33*a* that is the rotation axis of the base 33*c*1 in the radial direction, and the plurality of slits 33*c*3 are spaced out each other in the rotation axis direction. The plurality of slits 33*c*3 form a plurality of bent portions 33*c*2 spaced out each other in the rotation axis direction.

That is, the flap 33*c* according to the present embodiment is not one rectangular sheet having one substantially bent portion 33*c*2 formed on the tip. In the present embodiment, a plurality of slits 33*c*3 are formed in the tip of one substantially rectangular sheet to form a plurality of narrow width bent portions 33*c*2 separated in the rotation axis direction. The sheet is bent from the middle of each of the slits 33*c*3 to form each of the plurality of bent portions 33*c*2.

As described above, the flap 33*c* is separated in the rotation axis direction by the slits 33*c*3 to form the plurality of narrow width bent portions 33*c*2. The plurality of the narrow width bent portions 33*c*2 make smaller noise that occurs when the bent portion 33*c*2 hits the sliding contact surface 59*b* and passes through the end of the sliding contact surface 59*b* than one bent portion formed along an entire range of the flap 33*c* in the rotation axis direction.

As illustrated in FIG. 12 and FIG. 13, the flaps 33*c* according to the present embodiment are formed to extend in a plurality of different radial directions from the rotation shaft 33*a*.

Specifically, the flaps 33*c* are respectively formed in two directions shifted by 180 degrees in the rotation direction with the rotation shaft 33*a* interposed therebetween. In other words, the first stirrer 33A is formed such that the flaps 33*c* extend in two directions shifted by 180 degrees in the rotation direction, with the rotation shaft 33*a* interposed therebetween. Each of the flaps 33*c* has the bent portion 33*c*2 formed on the radial end thereof.

The bent portions 33*c*2 disposed in the plurality of directions contact and slide on the sliding contact surface 59*b* a plurality of times while the first stirrer 33A rotates once and can effectively prevent the toner from adhering to the sliding contact surface 59*b*.

Figure 13A:
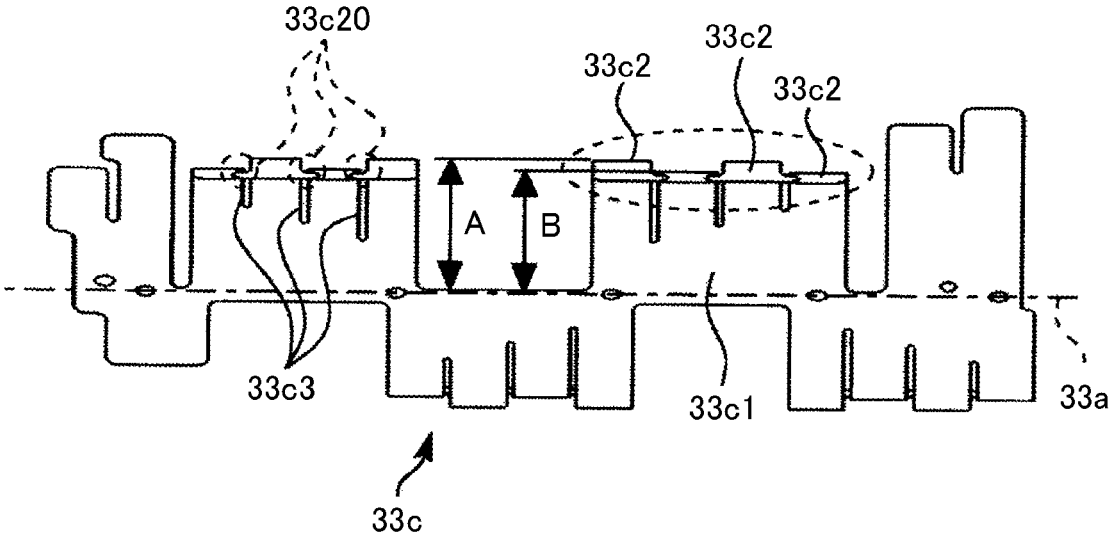
FIG. 13A is a top view illustrating a flap to which an external force is not applied, according to an embodiment of the present disclosure.

The flap 33*c* according to the present embodiment includes a plurality of comb-teeth tip portions disposed at intervals in the rotation axis direction. The comb-teeth tip portion includes the plurality of bent portions 33*c*2 lined up with the slit 33*c*3 therebetween. The flap 33*c* extending in one radial direction includes the comb-teeth tip portions adjacent to each other with a certain distance in the rotation axis direction. The flap 33*c* extending in the other radial direction includes the comb-teeth tip portion disposed in a range in which the flap 33*c* extending in the one radial direction does not have the comb-teeth tip portion. That is, as illustrated in FIG. 13A, the comb-teeth tip portions are disposed alternately above and below the rotation shaft 33*a* along the rotation axis direction.

Alternately arranging the plurality of comb-teeth tip portions in the different radial directions as described above can lead load variation while the first stirrer 33A makes one rotation to smaller than arranging all of the plurality of comb-teeth tip portions in the same radial direction.

In the flap 33*c* according to the present embodiment, the comb-teeth tip portion including the plurality of bent portions 33*c*2 lined up with the slit 33*c*3 therebetween has the plurality of slits 33*c*3 in the base 33*c*1 having different slit lengths each other in the radial direction.

The above-described configuration changes an amount of bending of each bent portion 33*c*2 occurring from the root portion of the bent portion 33*c*2 to the start point of each slit 33*c*3 in the base 33*c*1 and timings when each bent portion 33*c*2 contacts and slides on the sliding contact surface 59*b*. Compared with the case where the slit lengths of all the slits 33*c*3 are the same, the above-described configuration can reduce a load variation occurring during one rotation of the first stirrer 33A.

As illustrated in FIG. 13A, in the flap 33*c* according to the present embodiment, the bent portions 33*c*2 adjacent to each other have different bent positions each other. The bent position is the position at which the base 33*c*1 extending in the radial direction is bent to form the bent portion 33*c*2. Specifically, the flap 33*c* illustrated in FIG. 13A includes the bent portion 33*c*2 bent from the base 33*c*1 at a bent position at a distance A from the center of the rotation shaft 33*a* and the bent portion 33*c*2 bent from the base 33*c*1 at a bent position at a distance B from the center of the rotation shaft 33*a*. That is, the plurality of bent portions 33*c*2 includes the bent portion 33*c*2 having the bent position away from the rotation shaft 33*a* and the bent portion 33*c*2 having the bent position near the rotation shaft which are adjacent to each other and alternately arranged.

Figure 14A:
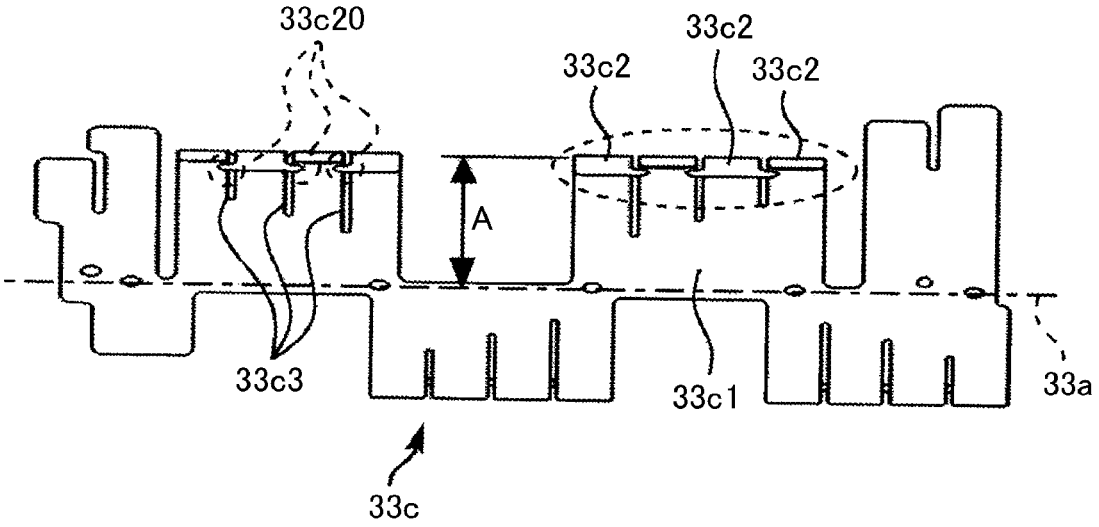
FIG. 14A is a top view illustrating a flap to which an external force is not applied, according to in another embodiment of the present disclosure.
Figure 14B:
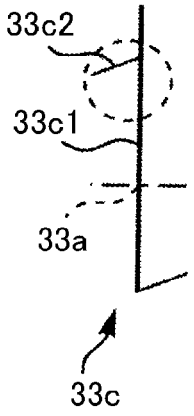
FIG. 14B is a side view illustrating the flap of FIG. 14A to which the external force is not applied.
Figure 14C:
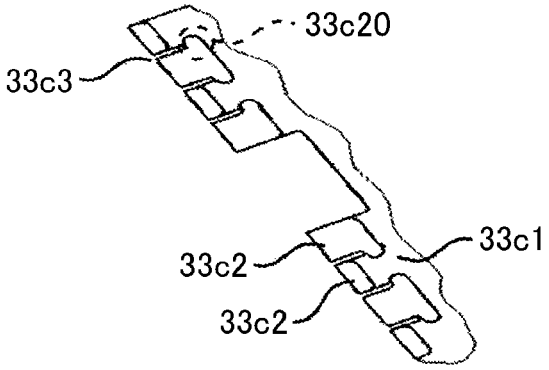
FIG. 14C is a perspective view illustrating a part of the flap of FIG. 14A to which the external force is not applied.

The above-described configuration can vary timings at which the plurality of bent portions 33*c*2 contact the sliding contact surface 59*b* compared with a configuration of the flap 33*c* illustrated in FIG. 14 in which lengths from the center of the rotation shaft to the bent positions of all bent portions 33*c*2 are the same. Accordingly, the above-described configuration illustrated in FIG. 13A can reduce a load variation occurring during one rotation of the first stirrer 33A.

Figure 13B:
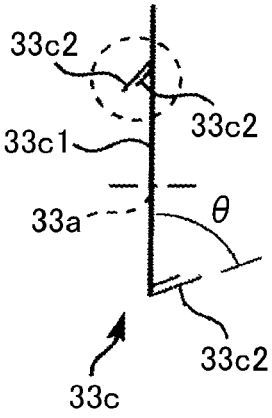
FIG. 13B is a side view illustrating the flap of FIG. 13A to which the external force is not applied.

In addition, as illustrated in FIG. 13B, in the flap 33*c* according to the present embodiment, the bent portions 33*c*2 adjacent to each other extend in the direction intersecting the radial direction and have different lengths each other in the direction intersecting the radial direction. The length is from the bent position to the tip of the bent portion 33*c*2. That is, the plurality of bent portions 33*c*2 includes the bent portion 33*c*2 having the long length from the bent position to the tip and the bent portion 33*c*2 having the short length from the bent position to the tip, which are adjacent to each other and alternately arranged.

The above-described configuration can vary timings at which the plurality of bent portions 33*c*2 contact and slide on the sliding contact surface 59*b* compared with a configuration of the flap 33*c* illustrated in FIG. 14 in which lengths from the bent positions to the tips in all bent portions 33*c*2 are the same. Accordingly, the above-described configuration illustrated in FIG. 13B can reduce a load variation occurring during one rotation of the first stirrer 33A.

Figure 13C:
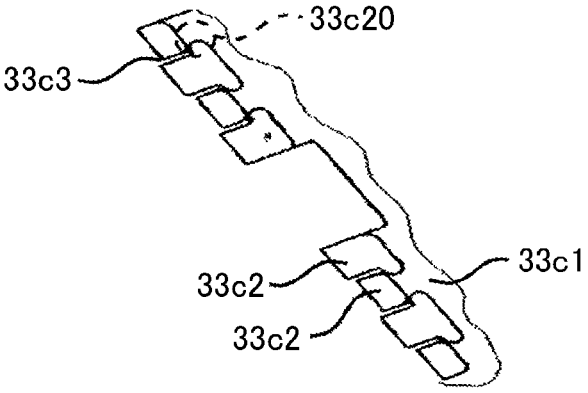
FIG. 13C is a perspective view illustrating a part of the flap of FIG. 13A to which the external force is not applied.

In addition, as illustrated in FIG. 13C, in the flap 33*c* according to the present embodiment, the bent portion 33*c*2 that is long in the direction intersecting the radial direction has a wide portion 33*c*20 that projects toward the adjacent bent portions 33*c*2 and the slits 33*c*3. That is, among the plurality of bent portions 33*c*2, the bent portion 33*c*2 having a long length from the bent position to the tip has the wide portion 33*c*20 projecting toward the adjacent bent portions 33*c*2 in the rotation axis direction at the tip of the bent portion 33*c*2.

The flap 33*c* not having the wide portion 33*c*20 may not contact the sliding contact surface 59*b* at positions corresponding to the slits 33*c*3. In the above-described configuration, the wide portions 33*c*20 can contact and slide the sliding contact surface 59*b* at the positions corresponding to the slits 33*c*3 when the plurality of bent portions 33*c*2 contact and slide on the sliding contact surface 59*b*. Accordingly, the above-described configuration can sufficiently prevent the toner from adhering to the sliding contact surface 59*b*.

As described above, the toner container 30 according to the present embodiment includes the first stirrer 33A serving as the rotator that rotates in a certain rotation direction on the rotation shaft 33*a*. The first stirrer 33A includes the flap 33*c* that can contact and slide on the sliding contact surface 59*b* that is the inner wall surface of the toner container 30. The flap 33*c* includes the base 33*c*1 extending from the rotation shaft 33*a* in the radial direction and the bent portion 33*c*2 bent from the base 33*c*1 in the direction intersecting the radial direction and directed toward downstream in the rotation direction of the first stirrer 33A.

As a result, the flap 33*c* can sufficiently scrape off the toner T adhered to the sliding contact surface 59*b* that is the inner wall surface of the toner container 30.

In the above-described embodiments, the present disclosure is applied to the process cartridge 10 as a single unit including the photoconductor drum 1 serving as an image bearer, the charging roller 4 serving as a charger, the developing device 5, the cleaner 2, and the waste toner conveyor 6. However, the present disclosure is not limited to the embodiments described above and may be applied to the image forming apparatus in which each of the above-described devices (i.e., the photoconductor drum 1, the charging roller 4, the developing device 5, the cleaner 2, and the waste toner conveyor 6) is removably installed as a single unit into the image forming apparatus 100.

In such configurations, similar effects to the embodiments described above are also attained.

It is to be noted that the term "process cartridge" used in the above means a removable device (a removable unit) including an image bearer and at least one of a charger to charge the image bearer, a developing device to develop latent images on the image bearer, and a cleaner to clean the image bearer that are united together, and is designed to be removably installed as a united part in the apparatus body of the image forming apparatus.

In the above-described embodiment, the present disclosure is applied to the toner container 30 included in the image forming apparatus 100 that performs monochrome image formation. Alternatively, the present disclosure may be applied readily to a toner container included in a color image forming apparatus.

In the above-described embodiments, the present disclosure is applied to the toner container 30 indirectly installed in and removed from the image forming apparatus 100 via the process cartridge 10. Alternatively, the present disclosure may be applied to a toner container directly installed in and removed from the image forming apparatus 100 without going through the process cartridge 10.

In the above-described embodiments, the present disclosure is applied to the toner container 30 to store toner that is the one-component developer and supply the toner to the developing device 5 for a one-component developing method. Alternatively, the present disclosure may be applied to a toner container to supply toner to the developing device 5 that stores two-component developer including toner and carrier for a two-component developing method.

In the above-described embodiments, the present disclosure is applied to the toner container 30 in which toner is stored and collected. Alternatively, the present disclosure may be applied to a toner container in which a two-component developer is stored and collected. The two-component developer is a mixture of toner and carrier. In this case, a developing device employs the two-component developing method.

In the above-described embodiments, the present disclosure is applied to the toner container 30 including the toner storage 31 and the waste toner collection portion 32 as a single unit. Alternatively, the present disclosure may be applied to a toner container including only the toner storage.

Any of the cases described above exhibits the same advantages as the advantages of the present embodiment.

In the above-described embodiments, the present disclosure is applied to the toner storage 31 of the toner container 30 to supply toner to the developing device 5, but the powder container to which the present disclosure is applied is not limited thereto. Alternatively, the present disclosure may be applied to a developing device to store toner and develop a latent image formed on an image bearer to a toner image (for example, the developing device 5 in the above-described embodiment). That is, the present disclosure may be applied to a stirrer in the developing device. Further, the present disclosure may be applied to other powder containers such as the cleaner 2 or the waste toner collection portion 32 in the above-described embodiment included in the image forming apparatus and other powder containers included in the developing device.

Any of the cases described above exhibits the same advantages as the advantages of the present embodiment.

The above-described embodiments are illustrative and do not limit the present disclosure. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. Further, features of components of the embodiments, such as the number, the position, and the shape are not limited the embodiments and thus may be preferably set.

What is claimed is:

1. A powder container, comprising:

a rotator configured to rotate on a rotation axis as a rotation center and including a flap configured to contact and rub against an inner wall surface of the powder container, the flap including a base extending from the rotation axis as the rotation center in a radial direction, and a bent portion bent from the base in a direction intersecting the radial direction and toward downstream in a rotation direction of the rotator, wherein the flap further includes a plurality of slits disposed in a rotation axis direction and extending from start points away from the rotation axis on the base in the radial direction to form a plurality of bent portions disposed in the rotation axis direction and including the bent portion, and the bent portions adjacent to each other have different bending positions at which the bases are bent to form the bent portions.

2. The powder container according to claim 1, wherein the rotator further includes a holder having rigidity and extending in the radial direction to hold a part of the base of the flap.

3. The powder container according to claim 1, wherein a bending angle of the bent portion with respect to the base is in a range of 60 to 120 degrees during use.

4. The powder container according to claim 3, wherein the bending angle is an acute angle before the powder container is used.

5. The powder container according to claim 1, wherein the bent portions adjacent to each other extend in the direction intersecting the radial direction and have different lengths in the direction intersecting the radial direction.

6. The powder container according to claim 5, wherein, of the bent portions adjacent to each other, one bent portion having a longer length than another bent portion in the direction intersecting the radial direction has a wide portion at a tip, the wide portion projecting toward said another bent portion.

7. The powder container according to claim 1, wherein the powder container stores toner as the powder.

8. A process cartridge, comprising:

the powder container according to claim 1.

9. An image forming apparatus, comprising:

the powder container according to claim 1.

10. A powder container, comprising:

a rotator configured to rotate on a rotation axis as a rotation center and including a flap configured to contact and rub against an inner wall surface of the powder container, the flap including a base extending from the rotation axis as the rotation center in a radial direction, and a bent portion bent from the base in a direction intersecting the radial direction and toward downstream in a rotation direction of the rotator, wherein the powder container further includes a reservoir disposed downstream in the rotation direction from the inner wall surface on which the flap contacts and slides, the reservoir being configured to store powder scraped off from the inner wall surface; and a stirrer configured to stir powder stored in the reservoir, wherein the rotation axis of the rotator is above the reservoir.

11. The powder container according to claim 10, wherein the rotator further includes a holder having rigidity and extending in the radial direction to hold a part of the base of the flap, and a rotation trajectory of the holder when the holder rotates about the rotation axis in the rotation direction of the rotator is above the reservoir and not above the inner wall surface.

12. A developing device, comprising:

the powder container according to claim 10.

13. A process cartridge, comprising:

the powder container according to claim 10.

14. An image forming apparatus, comprising:

the powder container according to claim 10.

15. A developing device, comprising:

a rotator configured to rotate on a rotation axis as a rotation center, including a flap configured to contact and rub against an inner wall surface of the powder container, the flap including a base extending from the rotation axis as the rotation center in a radial direction, and a bent portion bent from the base in a direction intersecting the radial direction and toward downstream in a rotation direction of the rotator, wherein the flap further includes a plurality of slits disposed in a rotation axis direction and extending from start points away from the rotation axis on the base in the radial direction to form a plurality of bent portions disposed in the rotation axis direction and including the bent portion, and the bent portions adjacent to each other have different bending positions at which the bases are bent to form the bent portions.

* * * * *